US006698309B2

(12) United States Patent
Rixon et al.

(10) Patent No.: US 6,698,309 B2
(45) Date of Patent: Mar. 2, 2004

(54) DIRECT DRIVE ADJUSTABLE PEDAL ASSEMBLY

(75) Inventors: Christopher Rixon, Tecumseh (CA); Jiyuan Ouyang, Windsor (CA)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

(21) Appl. No.: 10/365,562

(22) Filed: Feb. 12, 2003

(65) Prior Publication Data

US 2003/0121356 A1 Jul. 3, 2003

Related U.S. Application Data

(63) Continuation of application No. 10/040,096, filed on Jan. 1, 2001.

(51) Int. Cl.[7] ..... G05G 1/14
(52) U.S. Cl. ..... 74/512; 74/514; 74/560
(58) Field of Search ..... 74/512, 514, 560

(56) References Cited

U.S. PATENT DOCUMENTS

| | | | | | |
|---|---|---|---|---|---|
| 3,586,953 | A | * | 6/1971 | Markkanen et al. | 318/68 |
| 3,643,524 | A | | 2/1972 | Herring | 74/512 |
| 4,875,385 | A | | 10/1989 | Sitrin | 74/512 |
| 4,989,474 | A | | 2/1991 | Cicotte et al. | 74/512 |
| 5,127,606 | A | * | 7/1992 | Chan et al. | 244/54 |
| 5,632,183 | A | * | 5/1997 | Rixon et al. | 74/512 |
| 5,697,260 | A | | 12/1997 | Rixon et al. | 74/514 |
| 5,722,302 | A | | 3/1998 | Rixon et al. | 74/512 |
| 5,927,154 | A | * | 7/1999 | Elton et al. | 74/512 |
| 5,964,125 | A | | 10/1999 | Rixon et al. | 74/512 |
| 6,151,984 | A | | 11/2000 | Johansson et al. | 74/512 |
| 6,205,883 | B1 | * | 3/2001 | Bortolon | 74/512 |
| 6,247,381 | B1 | * | 6/2001 | Toelke et al. | 74/512 |
| 6,301,993 | B1 | * | 10/2001 | Orr et al. | 74/512 |
| 6,352,007 | B1 | | 3/2002 | Zhang et al. | 74/512 |
| 6,431,304 | B1 | * | 8/2002 | Smythe | 180/334 |
| 6,450,061 | B1 | | 9/2002 | Chapman et al. | 74/512 |
| 6,510,761 | B2 | | 1/2003 | Zhang et al. | 74/512 |
| 2002/0078782 | A1 | | 6/2002 | Flynn | 74/512 |
| 2002/0078785 | A1 | | 6/2002 | Zhang et al. | 74/512 |
| 2002/0096011 | A1 | | 7/2002 | Chapman et al. | 74/512 |
| 2002/0194948 | A1 | | 12/2002 | Sundaresan et al. | 74/560 |
| 2003/0005790 | A1 | | 1/2003 | Liimatta et al. | 74/512 |

* cited by examiner

*Primary Examiner*—David A. Bucci
*Assistant Examiner*—Julie K. Smith
(74) *Attorney, Agent, or Firm*—Howard & Howard

(57) ABSTRACT

A pair of first (14) and second (34) pedal levers is pivotally supported for rotation by a support (12). A pair of adjustment mechanisms (21, 41) interconnect the support (12) and the respective pedal levers (14, 34) and include rods (28, 48) for adjusting the operational position of the pedal levers (14, 34) along the rods (28, 48) between a plurality of adjusted positions. A motor (52) and screw (32) unit is attached to the inner end of each rod (28, 48) for moving the respective pedal levers (14, 34) along the respective rods (28, 48). A controller (56) is programmed to detect a stall of either of the motors (52). The assembly (10) is characterized by the controller (56) having a coordinator (66) to automatically reposition at least one of the motors (52) to a corrected position in response to a stall by at least one of the motors (52).

12 Claims, 5 Drawing Sheets

PWM KICK-IN TIMING
(mS)

DIRECT DRIVE ADJUSTABLE PEDAL ASSEMBLY

RELATED APPLICATION

This application is a continuation of co-pending application Ser. No. 10/040,096, filed Jan. 1, 2002.

BACKGROUND OF THE INVENTION

1. Field of the Invention

The subject invention relates to an adjustable pedal assembly used in an automotive vehicle to vary the operating position of one or more of the foot pedals to mechanically or electrically control various vehicle systems, such as the clutch, brake and throttle systems.

2. Description of the Prior Art

Typically, adjustable pedal assemblies have used direct current electrical motors to rotate a drive cable that, in turn, rotates a worm gear to adjust the position of the pedal. Examples of such assemblies are shown in U.S. Pat. Nos. 5,632,183; 5,697,260; 5,722,302 and 5,964,125 to Rixon et al, 3,643,524 to Herring, 4,875,385 to Sitrin, 4,989,474 to Cicotte et al and 5,927,154 to Elton et al. Other assemblies eliminate the cable and connect the worm gear more directly to a pedal lever, as illustrated in U.S. Pat. Nos. 6,205,883 to Bortolon and 6,151,984 to Johansson et al. In order to stay within cost limitations, these assemblies require a relatively large number of parts, are noisy and imprecise in output. They also present difficult packaging parameters.

Strict standards have been developed in regard to the position of the brake pedal relative to the position of the accelerator pedal. Some assemblies address this requirement by using one motor to drive the adjustment of both pedals, as shown in the aforementioned U.S. Pat. No. 5,722,302.

SUMMARY OF THE INVENTION AND ADVANTAGES

The subject invention provides an adjustable pedal assembly comprising a support for mounting the assembly to a vehicle structure. A first pedal lever is pivotally supported for rotation about an operational axis relative to the support and a second pedal lever is pivotally supported for rotation about another operational axis relative to the support. A first adjustment mechanism interconnects the support and the first pedal lever and includes a first motor for adjusting the operational position of the first pedal lever between a first plurality of adjusted positions relative to the support. A second adjustment mechanism interconnects the support and the second pedal lever and includes a second motor for adjusting the operational position of the second pedal lever relative to the support. A controller is programmed to operate the first and second motors to simultaneously move the first and second pedal levers between the adjusted positions. The controller is also programmed to detect a stall of each of the motors. The assembly is characterized by the controller having a coordinator for automatically repositioning at least one of the motors to a corrected position in response to a stall by at least one of the motors thereby repositioning at least one of the pedal levers relative to the other to maintain a predetermined relationship between the pedal levers.

Accordingly, the subject invention provides an adjustable pedal assembly that reduces the total number of parts while providing a quieter and more precise and controllable adjustment.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
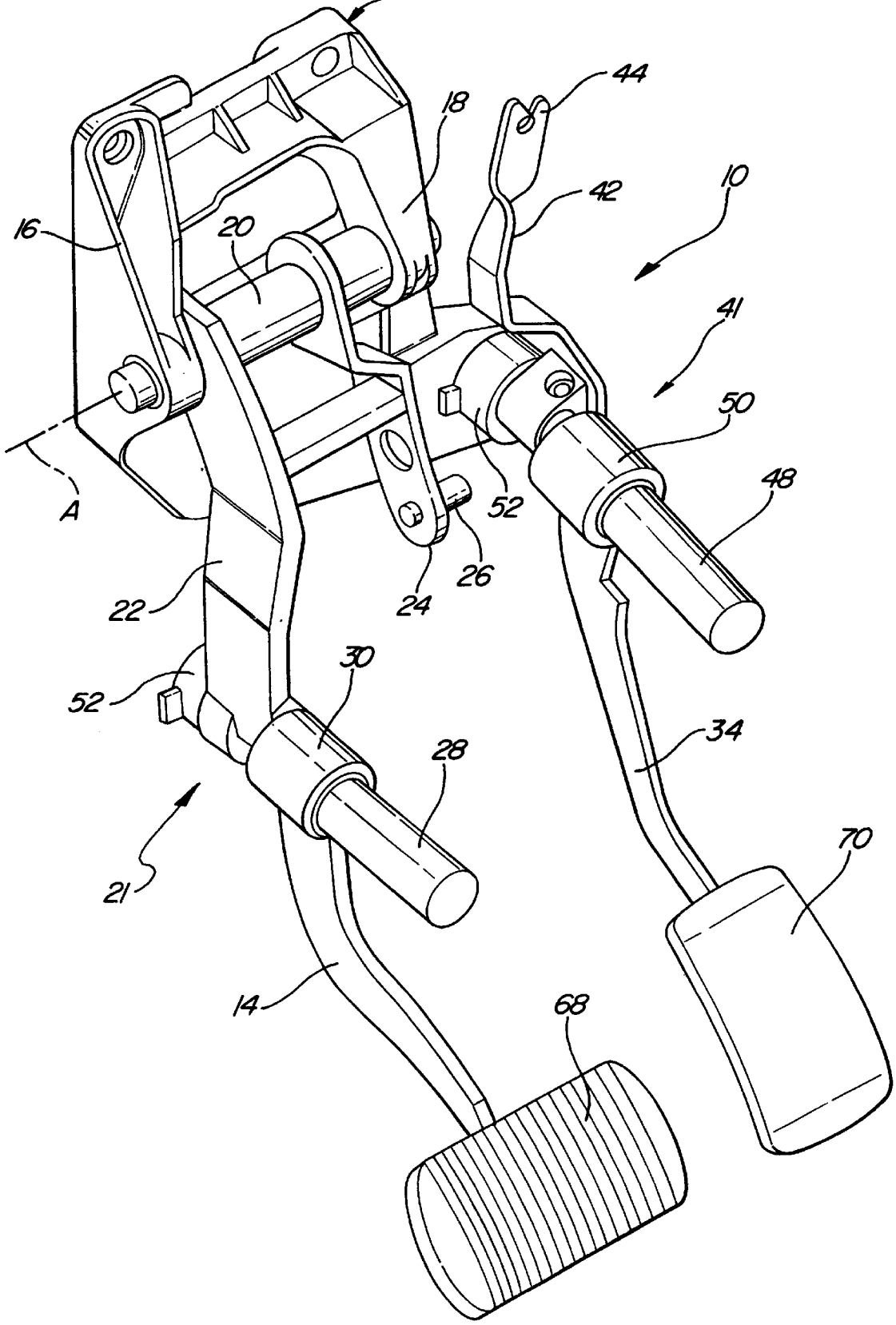
FIG. 1 is a perspective view from the left of a preferred embodiment.
Figure 2:
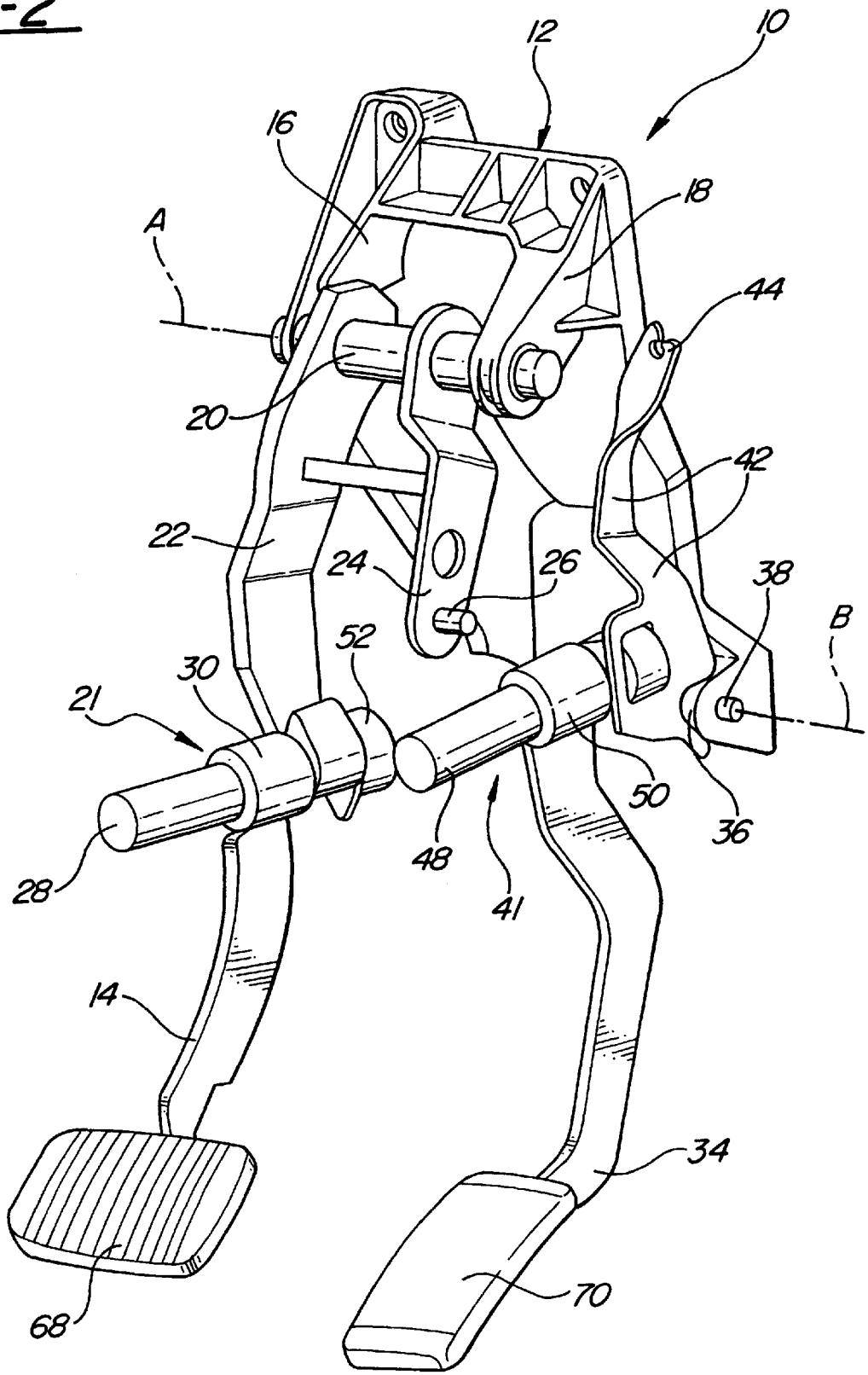
FIG. 2 is a perspective view from the right of the preferred embodiment.

Referring to the Figures, wherein like numerals indicate like or corresponding parts throughout the several views, an adjustable pedal assembly is generally shown at 10 in FIGS. 1 and 2. A support, generally indicated at 12, is included for mounting the assembly to a vehicle structure.

Figure 4:
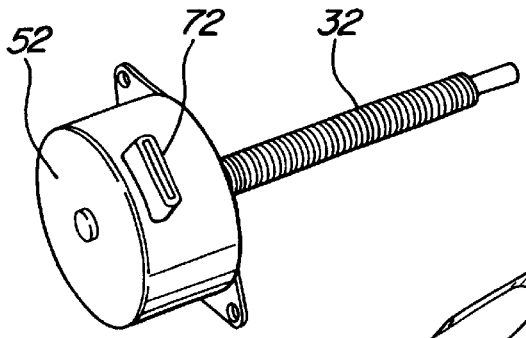
FIG. 4 is a perspective view of the motor and drive control.
Figure 5:
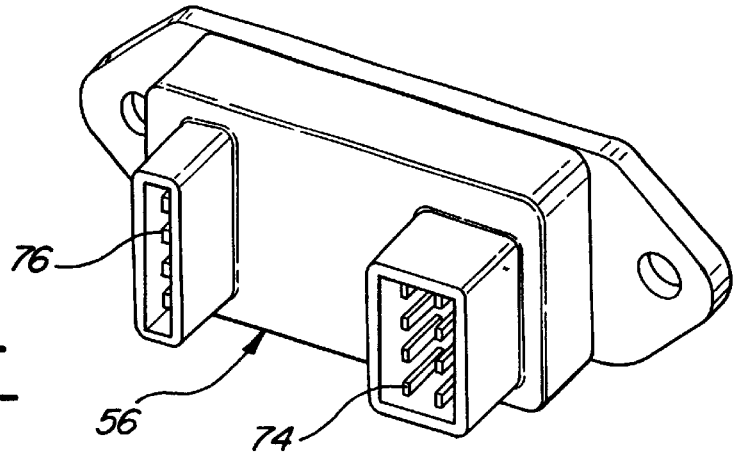
FIG. 5 is a perspective view of a controller of the subject assembly.
Figure 3:
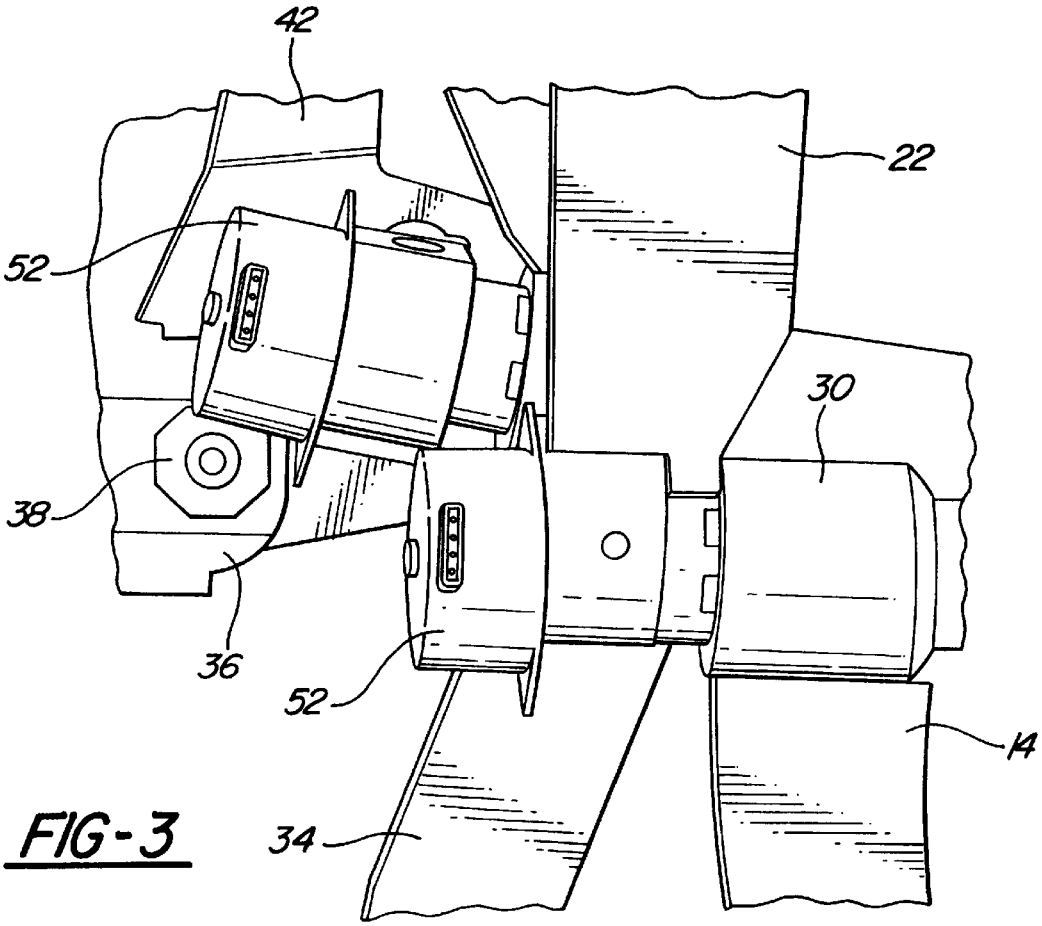
FIG. 3 is an enlarged side view showing the motors and pedal levers.

A first pedal lever 14 is pivotally supported for rotation about an operational axis A with respect to the support 12. The support 12 comprises a bracket having side flanges 16 and 18 that rotatably support a shaft 20. A first adjustment mechanism, generally indicated at 21, interconnects the support 12 and the pedal lever 14 for adjusting the operational position of the pedal lever 14 relative to the operational axis (A) between a plurality of adjusted positions. More specifically, the shaft 20 supports a first arm 22. A line 24 depends from the shaft 20 and supports an attachment 26 that connects to the vehicle system for operating a system thereof, e.g., a brake system. As is well known in the art, any one of the shaft 20, arm 22 or link 24 could be connected to an electrical generator for sending an electrical signal to a vehicle system instead of a mechanical output. The first adjustment mechanism also includes a guide, in the form of a rod 28, movably supported by the support 12, and the pedal lever 14 includes a collar 30 that is slidably supported by the rod 28. The rod 28 is hollow and a nut (not shown) is moved axially within the rod 28 by a screw 32, as shown in FIG. 4. Such an assembly is illustrated in the aforementioned U.S. Pat. Nos. 5,722,302 and 5,964,125. However, as will be appreciated, the guide may take the form of a plate that slidably supports the pedal lever, the plate being either slidable or rotatable relative to the support.

The assembly 10 also includes a second pedal lever 34 pivotally supported for rotation about a second operational axis B with respect to the support 12. The bracket defining the support 12 includes an ear 36 that supports a pin 38. A second adjustment mechanism, generally shown at 41, interconnects the support 12 and the second pedal lever 34 for adjusting the operational position of the second pedal lever 34 relative to the second operational axis B between a plurality of adjusted positions. The second adjustment mechanism includes a second arm 42 pivotally supported by the pin 38. The upper end 44 of the second arm 42 is bifurcated to connect to a control cable, but as set forth above, the output may be electrical instead of mechanical. Again, the second adjustment mechanism 41 includes a guide, in the form of a rod 48, movably supported by the support 12, and the second pedal lever 34 includes a collar 50 that is slidably supported by the rod 48. The rod 48 is hollow and a nut (not shown) is moved axially within the rod 48 by a screw 32, as shown in FIG. 4. This screw 32 and nut arrangement can be like that shown in the aforementioned Rixon et al patents.

Figure 6:
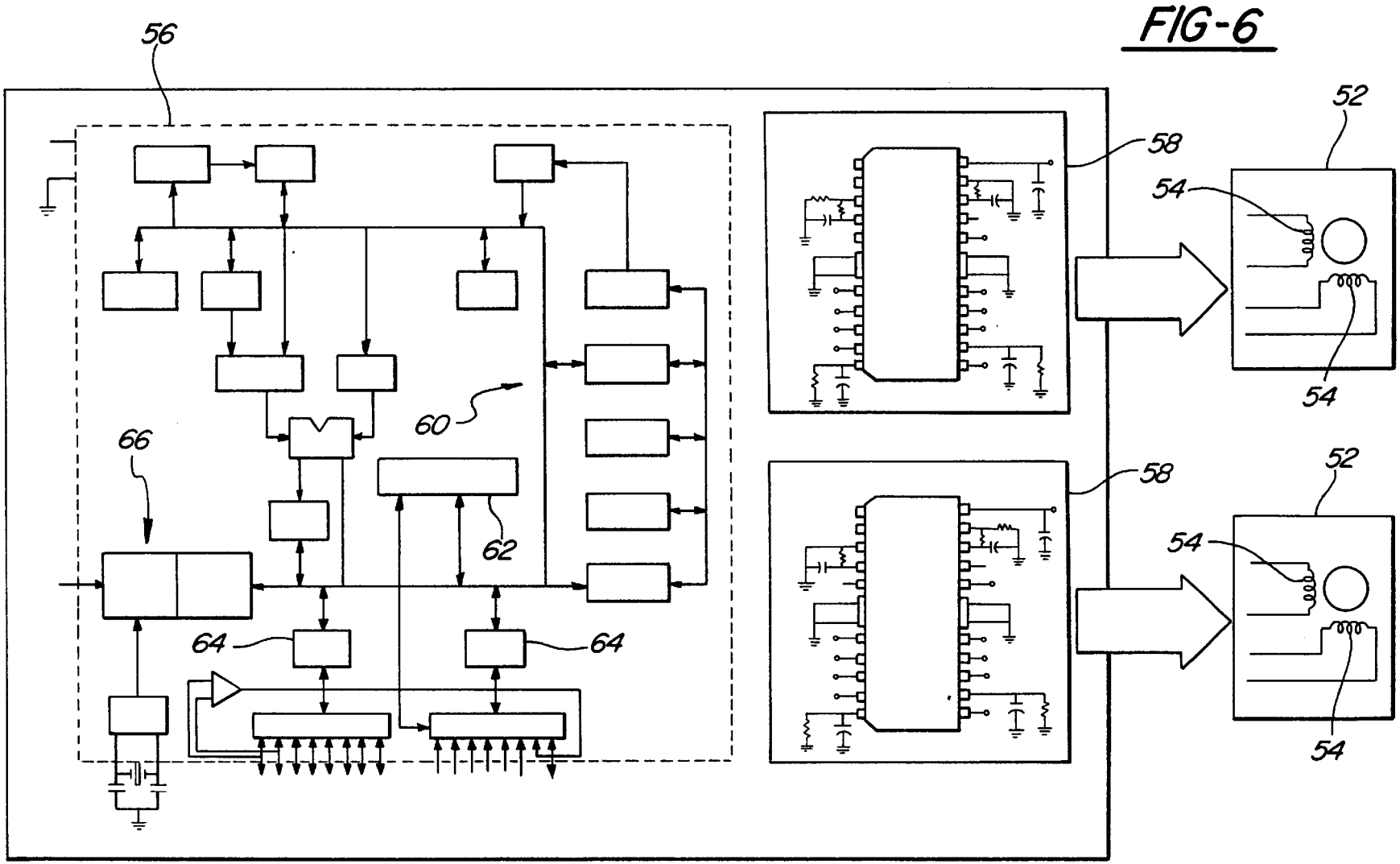
FIG. 6 is schematic view of the controller and motors.

The assembly 10 is characterized by each of the mechanisms 21 and 41 including an electrically operated motor 52 for sequentially moving in increments of movement. Such a motor 52 indexes when energized in a programmed manner. The normal operation consists of discrete angular motions of uniform magnitude rather than continuous motion. As shown in FIG. 6, each motor 52 includes a plurality of windings 54. Each motor 52 has a housing surrounding the motor 52 and the screw 32 extends from the housing whereby the screw 32 and motor are a compact and universal unit. A motor housing is attached to the respective ends of the rods 28 and 48 with the screw 32 thereof extending into the associated rod 28 or 48 for moving the pedal levers 14 and 34 between the adjusted positions. It is important that the motor 52 be connected directly to the screw 32, i.e., that the screw 32 extends out of and is supported by the housing surrounding the motor 52. No loads from the operator to the pedal lever occur during the adjustment and the force required to move the collars 30 and 50 along the rods 28 and 48 is relatively low. However, the collars 30 and 50 cock or tilt relative to the axis of the rods 28 and 48 in response to a force on the pedal pads 68 or 70. This tilting or cocking locks the collar 30 and/or 50 to the associated rod 28 or 48 whereby the force is transferred to the support 12 and not to the motor/screw 52/32 unit.

Figure 7:
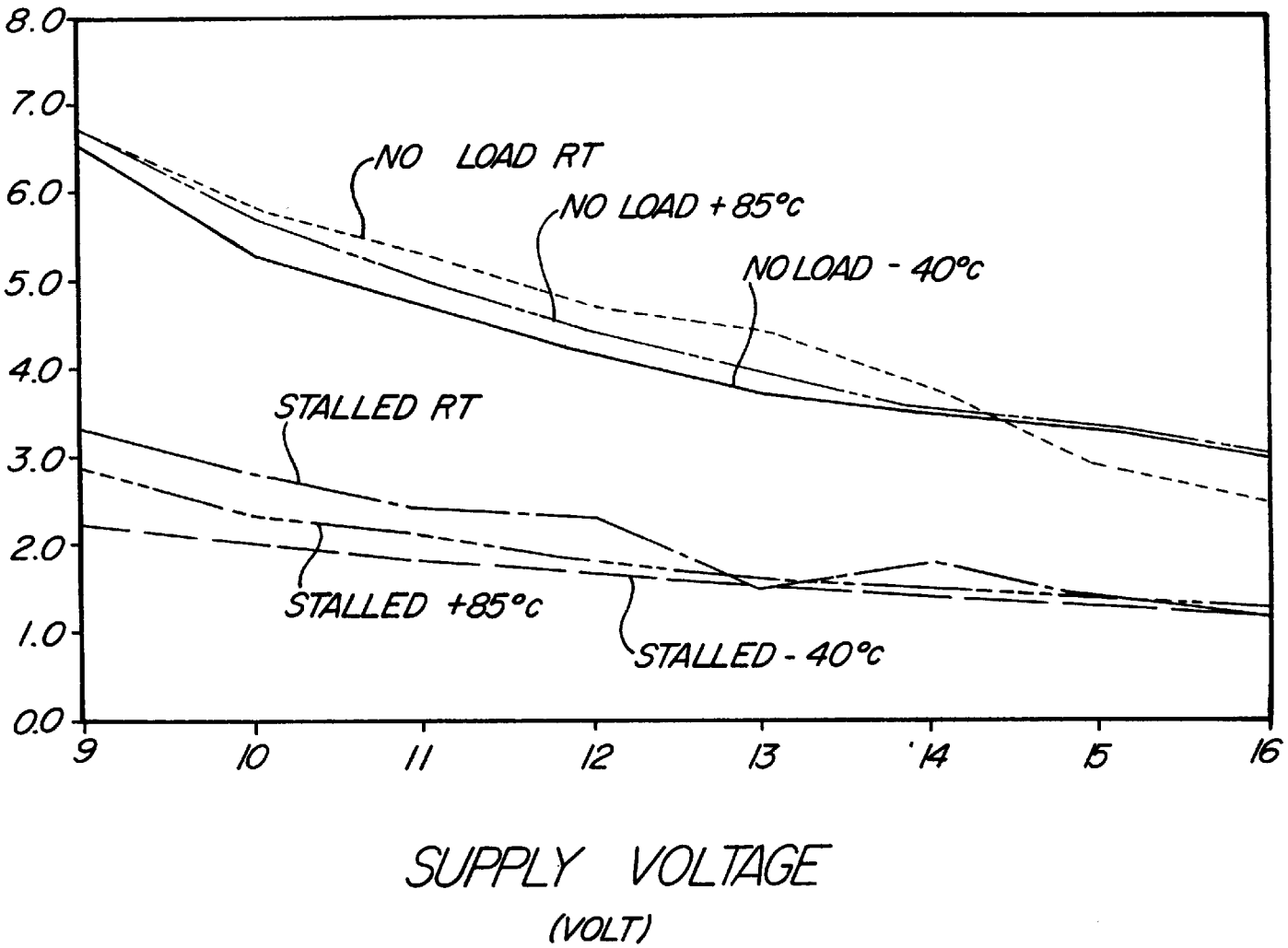
FIG. 7 is a graph showing the voltage timing.

As shown in FIG. 6, a controller 56 is included for sending pulses of electrical energy sequentially to the windings 54 to incrementally rotate the motor 52 through a predetermined angle in response to each pulse. Each motor 52 includes a drive circuit 58 interconnecting the controller 56 and the respective drives 58, which drives, in turn, energize the windings 54. The controller 56 includes a memory, generally shown at 60 in FIG. 6, for summing the pulses to keep track of the operational position of the pedal lever 14 in all adjusted positions. The controller 56 also includes a timer 62 for measuring the time to reach a predetermined pulse width modulation sufficient to rotate the motor 52. Attendant to this, the controller 56 includes latches each of which includes a voltage meter 64 for determining the voltage applied during the measured time to reach the predetermined pulse width modulation. The controller 56 includes a coordinator 66 for measuring the time to reach the predetermined pulse width modulation to alter the pulses of electrical energy to move the pedal lever 14 to the desired operational position in response to the time being outside a predetermined limit. In order to prevent the effects of the stall of a motor 52, thereby adversely affecting the desired or programmed position of the pedal lever, the controller 56 detects the stall and adjusts the pedal lever position or shuts down the system, thereby maintaining a predetermined relationship between the first 14 and second 34 pedal levers. When each winding 54 of a motor 52 is energized, the current sent to the motor 52 rises until a pulse width modulation (PWM) set point is reached. The time from energizing the winding to reaching the PWM set point is based on the voltage applied to the winding and any load on the system. As shown in FIG. 7, a stalled motor 52 differs from a properly operating motor 52 by the measured time from energization of the windings to reaching PWM set point, the measured time for a properly operating motor being approximately twice the measured time for a stalled motor. Accordingly, the controller 56 measures the time and voltage to detect a stall, and when one occurs, corrects to reposition the motor to the programmed position thereby reestablishing the predetermined relationship between the first 14 and second 34 pedal levers. In addition, the controller 56 includes a software program for adjusting the respective operational positions of the first 14 and second 34 pedal levers in the predetermined relationship to one another.

It is desirable that the pedal levers 14 and 34 be adjusted in unison to accommodate different operators. The controller 56 sending equal signals to the respective motors 52 may accomplish this. However, in some cases where the mounting of the two pedal levers 14 and 34 differ substantially (as is in the embodiment illustrated herein), the controller sends disproportionate signals to the two motors to maintain equal or equivalent movement of the pedal pads 68 and 70 on the lower or distal ends of the respective pedal levers 14 and 34.

An electrical connector 72 for the winding 54 extends out of the motor housing. The controller 56 and motor drive 58 are disposed within a separate housing from which extends an electrical connector 74 to connect to an electrical cable which divides and connects to the two motor connectors 72. An additional electrical connector 76 connects to an electrical cable that leads to the vehicle system.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. An adjustable pedal assembly comprising;

a support (12), a first pedal lever (14) pivotally supported for rotation about an operational axis (A) relative to said support (12), a first adjustment mechanism (21) including a first motor (52) for adjusting said first pedal lever (14) between a first plurality of adjusted positions relative to said support (12) upon operation of said first motor (52), a second pedal lever (34) pivotally supported for rotation about a second operational axis (B) relative to said support (12), a second adjustment mechanism (41) including a second motor (52) for adjusting said second pedal lever (34) between a second plurality of adjusted positions relative to said support (12) upon operation of said second motor (52), and a controller (56) programmed for operating said first (52) and second (52) motors to simultaneously move said first (14) and second (34) pedal levers between said adjusted positions and for detecting a stall of each of said motors (52), said assembly characterized by said controller (56) having a coordinator (66) for automatically repositioning at least one of said motors (52) to a corrected position in response to a stall by at least one of said motors (52) thereby repositioning at least one of said pedal levers (14,34) relative to the other to maintain a predetermined relationship between said pedal levers (14,34).

2. An assembly as set forth in claim 1 wherein each of said adjustment mechanisms (21,41) includes a screw (32) engaging said pedal levers (14,34) for moving said pedal levers (14,34) between said adjusted positions and a motor housing surrounding each of said motors (52) with said screw (32) of each of said adjustment mechanisms (21,41) extending from said motor housing.

3. An assembly as set forth in claim 2 wherein each of said motors (52) moves in discrete and uniform increments of movement and each of said motors (52) include a plurality of windings (54) wherein said controller sends pulses of electrical energy sequentially to said windings (54) of each of said motors (52) to incrementally rotate each of said motors (52) through a predetermined angle in response to each pulse with said predetermined angles of rotation remaining of uniform magnitude so that each adjustment of said pedal levers (14,34) includes a plurality of said pulses and a plurality of said incremental movements.

4. An assembly as set forth in claim 3 wherein said controller (56) includes a memory (60) for summing said pulses sent to each of said motors (52) to keep track of said first (14) and second (34) pedal levers in all adjusted positions.

5. An assembly as set forth in claim 4 wherein said controller (56) includes a timer (62) for measuring a time to reach a predetermined pulse width modulation sufficient to rotate each of said motors (52).

6. An assembly as set forth in claim 5 wherein said controller (56) includes a voltage meter (64) for determining the voltage applied during said time to reach said predetermined pulse width modulation.

7. An assembly as set forth in claim 6 wherein said coordinator (66) measures said time to reach said predetermined pulse width modulation to alter the pulses of electrical energy sent to at least one of said motors (52) thereby moving at least one of said first (14) and second (34) pedal levers to the desired adjusted position in response to said time being outside a predetermined limit.

8. A method of operating an adjustable pedal assembly comprising first (14) and second (34) pedal levers and first (52) and second (52) motors for moving the pedal levers (14,34) through a plurality of adjusted positions wherein the motors (52) are operatively connected to a controller (56) and the controller (56) is programmed to detect a stall of each of the motors (52), said method comprising the steps of;

simultaneously moving the first (14) and second (34) pedal levers through the plurality of adjusted positions, and detecting a stall in at least one of the motors (52) while moving the first (14) and second (34) pedal levers through the plurality of adjusted positions, said assembly characterized by automatically repositioning at least one of the first (14) and second (34) pedal levers to a corrected position when the stall in at least one of the first (52) and second (52) motors is detected.

9. A method as set forth in claim 8 further including the step of summing pulses sent to each of the motors (52) to keep track of the first (14) and second (34) pedal levers in all adjusted positions.

10. A method as set forth in claim 9 further including the step of measuring a time to reach a predetermined pulse width modulation sufficient to rotate each of the motors (52).

11. A method as set forth in claim 10 further including the step of determining a voltage applied during the time to reach the predetermined pulse width modulation.

12. A method as set forth in claim 10 further including the step of altering the pulses of electrical energy sent to at least one of the motors (52) to move at least one of said first (14) and second (34) pedal levers to the desired adjusted position in response to the time to reach the predetermined pulse width modulation being outside a predetermined limit thereby reestablishing a predetermined relationship between the first (14) and second (34) pedal levers.

* * * * *

UNITED STATES PATENT AND TRADEMARK OFFICE

CERTIFICATE OF CORRECTION

PATENT NO. : 6,698,309 B2
DATED : February 12, 2003
INVENTOR(S) : Christopher Rixon et al.

It is certified that error appears in the above-identified patent and that said Letters Patent is hereby corrected as shown below:

Title page,
Item [63], Related U.S. Application Data, please replace "Continuation of application No. 10/040,096, filed on Jan. 1, 2001" with -- Continuation of application No. 10/040,096, filed Jan. 1, 2002 --.

Signed and Sealed this

Fifth Day of July, 2005

JON W. DUDAS
*Director of the United States Patent and Trademark Office*